US006715428B2

(12) United States Patent
Wilcox

(10) Patent No.: US 6,715,428 B2
(45) Date of Patent: Apr. 6, 2004

(54) ARTICULATING TABLE

(75) Inventor: Daniel Curtis Wilcox, Manassas, VA (US)

(73) Assignee: Wilcox Woodworks, Inc., Manassas, VA (US)

( * ) Notice: Subject to any disclaimer, the term of this patent is extended or adjusted under 35 U.S.C. 154(b) by 0 days.

(21) Appl. No.: 10/067,691

(22) Filed: Feb. 5, 2002

(65) Prior Publication Data

US 2003/0145766 A1 Aug. 7, 2003

(51) Int. Cl.[7] ..... A47B 57/00
(52) U.S. Cl. ..... 108/66; 108/64
(58) Field of Search ..... 108/64, 102, 103, 108/91, 94, 139, 93, 65, 66, 69; 248/188.8, 188.9, 188.91

(56) References Cited

U.S. PATENT DOCUMENTS

| | | | | | |
|---|---|---|---|---|---|
| 2,705,179 | A | * | 3/1955 | Hodgin | 108/64 |
| 3,002,787 | A | * | 10/1961 | Ziegenfuss | 108/64 |
| 4,223,613 | A | * | 9/1980 | Yoshizawa | 108/64 |
| 5,842,425 | A | * | 12/1998 | van der Aa | 108/64 |
| 5,943,966 | A | * | 8/1999 | Machado et al. | 108/64 |
| 5,967,058 | A | * | 10/1999 | Ambrose et al. | 108/64 |
| 6,161,487 | A | * | 12/2000 | Chang | 108/50.01 |
| 6,170,410 | B1 | * | 1/2001 | Gioacchini et al. | 108/153.1 |
| 6,497,184 | B1 | * | 12/2002 | Whitesitt | 108/64 |

FOREIGN PATENT DOCUMENTS

DE 4230436 A1 * 3/1994

* cited by examiner

*Primary Examiner*—Jose V. Chen
(74) *Attorney, Agent, or Firm*—Mayer Portkort & Williams, PC; Michael P. Fortkort

(57) ABSTRACT

An articulating table can be easily adjusted by meeting participants, thereby suiting a wide range of meeting conditions without lifting, carrying or requiring specialized help. Rollers and/or electric motors make this transition easy. The articulating table includes two or more leaves coupled to each other by a large horizontal pivot. These leaves can be moved to different angles relative to each other, allowing for changes in configuration and capacity. The articulation can be accomplished using a rule joint, wherein the pivoting members are attached with offsets allowing the leaves to be placed in the same plane. The rule joint is divided into two or more parts, each attached to a leaf. These pivot parts are circular and have either a protrusion or depression concentric to their center, which fits into a corresponding part on the other member. This male/female arrangement provides a bearing surface and maintains alignment as the leaves pivot. Intermediate leaves, if filled, have a hole in their pivot member to accommodate the bearing assembly. Connectors and overlapping slots in the inner layers hold the joint together and limit motion as necessary. A split base housing rollers supports the other ends of the leaves.

20 Claims, 16 Drawing Sheets

ARTICULATING TABLE

FIELD OF THE INVENTION

The present invention relates generally to furniture, and more particularly to furniture for use in meetings and assemblies, such as tables, conference tables, teleconferencing furniture, audio/video presentation furniture, and movie theatre furniture.

BACKGROUND

In today's business world, groups interact in many different ways. Some meet face-to-face, others view a presentation, either close up or at a distance. Still others may face an audience or just interact socially.

In some situations, it may be desirable to change configurations one or more times during a meeting, as when a general meeting breaks into subcommittees, and the reconvenes at the end.

Some tables attempting to meet these needs include unattached modules bobbing uneasily on a sea of carpet. Others require disassembly, moving sections and reassembly, which involves support personnel and potentially the loss of small parts.

The present invention is therefore directed to the problem of developing a conference or meeting table capable of being quickly and easily reconfigured to satisfy various group needs without requiring special parts or accessories.

SUMMARY OF THE INVENTION

The present invention solves these and other problems by providing an articulating table that opens at one end to form a multi-legged structure in one extreme while appearing as a normal conference table in another extreme.

According to one aspect of the present invention, an exemplary embodiment of the articulating table includes two or more leaves coupled to each other by a large horizontal pivot. As a result, the leaves can be moved to different angles relative to each other, allowing for changes in configuration and capacity.

According to another aspect of the present invention, the articulation can be accomplished using a rule joint, wherein the pivoting members are attached with offsets allowing the leaves to be placed in the same plane. The rule joint is divided into two or more pivot parts, each pivot part being attached to one of the two or more leaves.

According to another aspect of the present invention, the pivot parts have a circular shape and either a protrusion or depression concentric to their center, which fits into a corresponding part on another pivot part. This male/female arrangement provides a bearing surface and maintains alignment as the leaves pivot. Intermediate leaves, if filled, have a hole in their pivot member to accommodate the bearing assembly.

According to still another aspect of the present invention, connectors and overlapping slots in the inner layers hold the joint together and limit motion as necessary. A split base housing rollers supports the other ends of the leaves.

DETAILED DESCRIPTION

It is worthy to note that any reference herein to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The present invention provides inter alia an articulating table that can be used for multiple purposes, such as a conference table, a meeting room table, a teleconferencing table, a movie theatre table, and an audio/visual table to name only a few examples. The articulating table of the present invention can be easily adjusted by meeting participants, thereby suiting a wide range of meeting conditions without requiring lifting, carrying or specialized help. The articulating table's parts remain connected and need only be moved to the appropriate position when desired. Rollers, wheels and/or electric motors (if necessary or desired) can make this transition easily accomplished. More than one of these units can be grouped in different configurations greatly increasing the possibilities.

The articulating table of the present invention consists of two or more leaves connected to each other by a large horizontal pivot. These leaves can be moved to different angles relative to each other, allowing for changes in configuration and capacity.

According to one aspect of the present invention, the articulation can be accomplished using a rule joint, wherein the pivoting members are attached with offsets allowing the leaves to be placed in the same plane.

According to another aspect of the present invention, the pivot or rule joint may be divided into two or more parts, each of which is attached to a leaf. These pivot parts may be circular shaped (or other shapes) and have either a protrusion or depression concentric to their center, which fits into it corresponding part on the other member. This male/female arrangement provides a bearing surface and maintains alignment as the leaves pivot. Intermediate leaves, if filled, have a hole in their pivot member to accommodate the bearing assembly. Connectors and overlapping slots in the inner layers hold the joint together and limit motion as necessary. If desired, a split base or other arrangement housing rollers or wheels can be used to support the other ends of the leaves. For finishing purposes, the table's edge may be coped into the opposite member at the perimeter of the rotary section, thereby allowing for a smooth and unbroken edge profile as the table articulates.

Figure 1:
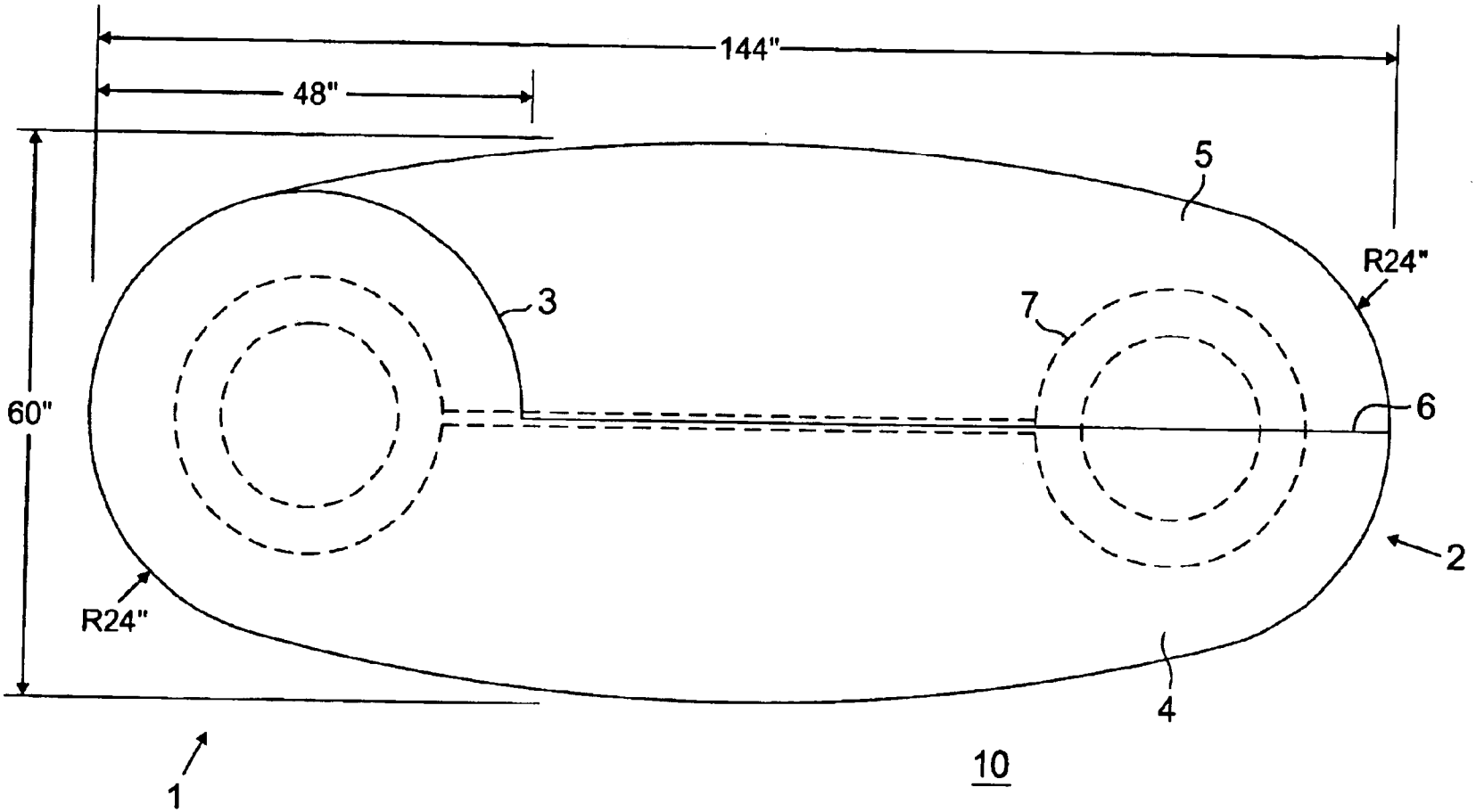
FIG. 1 depicts a top view of an exemplary embodiment of a conference table in a closed position according to one aspect of the present invention.
Figure 2:
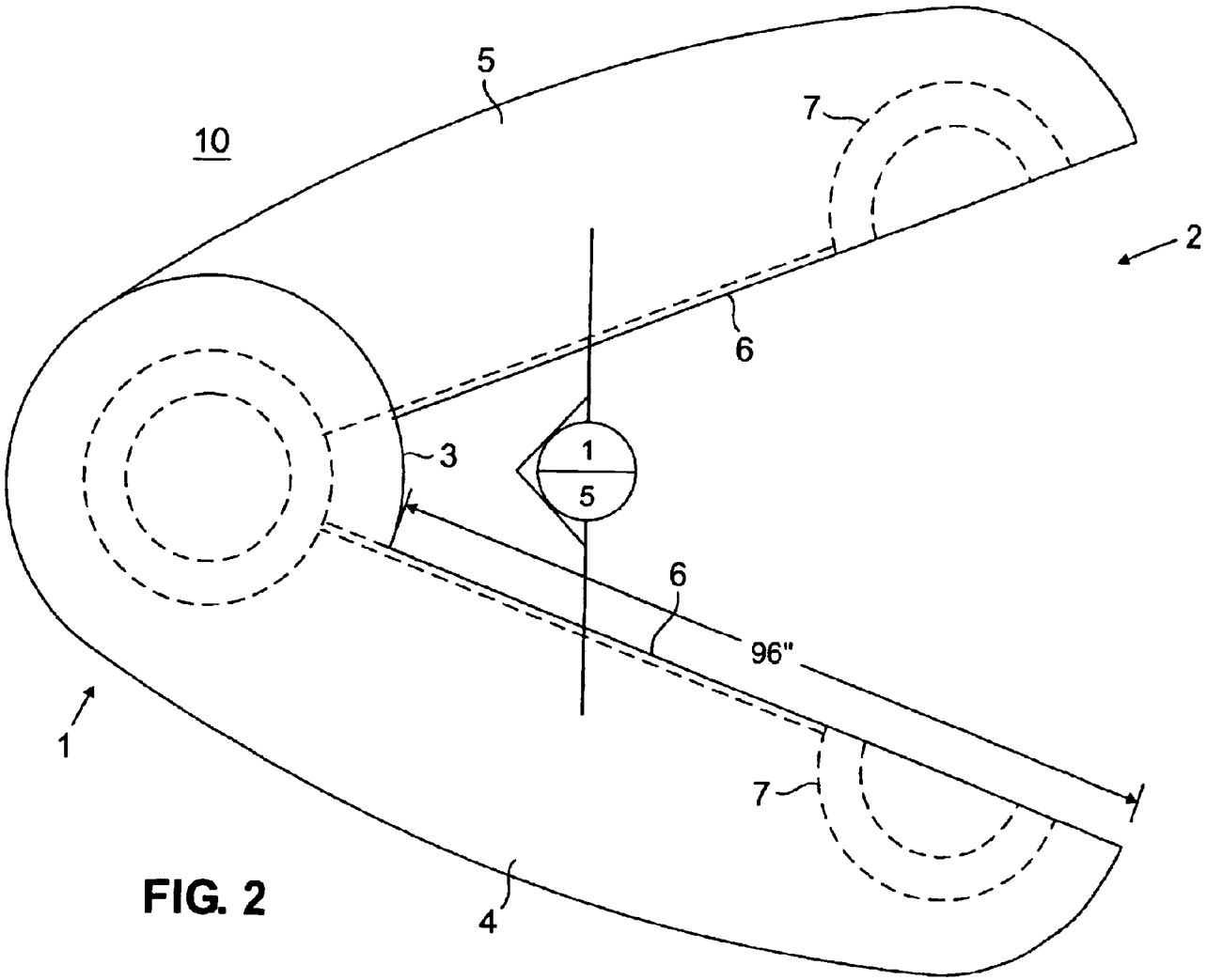
FIG. 2 depicts a top view of the exemplary embodiment shown in FIG. 1 in an open position according to one aspect of the present invention.

Turning to FIG. 1, shown therein is an exemplary embodiment 10 of a conference table according to one aspect of the present invention. The conference table 10 includes a pivoting end 1 and an openable end 2. The pivoting end 1 has a circular section 3 and two extended leaves 4, 5 that pivot about the circular section 3. The openable end 2 opens like a pair of scissors to a wide angle approaching almost 180 degrees. A seam or joint 6 exists where the two leaves 4, 5 meet. When in the closed position as shown in FIG. 1, there are slightly visible seams at 6 and 3. The slip joint (shown as an arc) 3 is the curve at which leaf 4 meets leaf 5. The circular portion of leaf 4 extends over the top of the circular portion of leaf 5, as can be seen in FIG. 2, which shows the table of FIG. 1 in the open position. The radius of the circular portion 3 is approximately 24 inches. A similar circular portion 7 exists on the openable end 2 of the table 10. The exterior shape of the leaves 4, 5 is selected for ornamental purposes and could be other curves than that shown herein. End to end the table is approximately 144 inches and 60 inches in width from its widest point. However, the dimensions used herein are only exemplary and many other dimensions are possible without departing from the scope of the invention.

Figure 9:
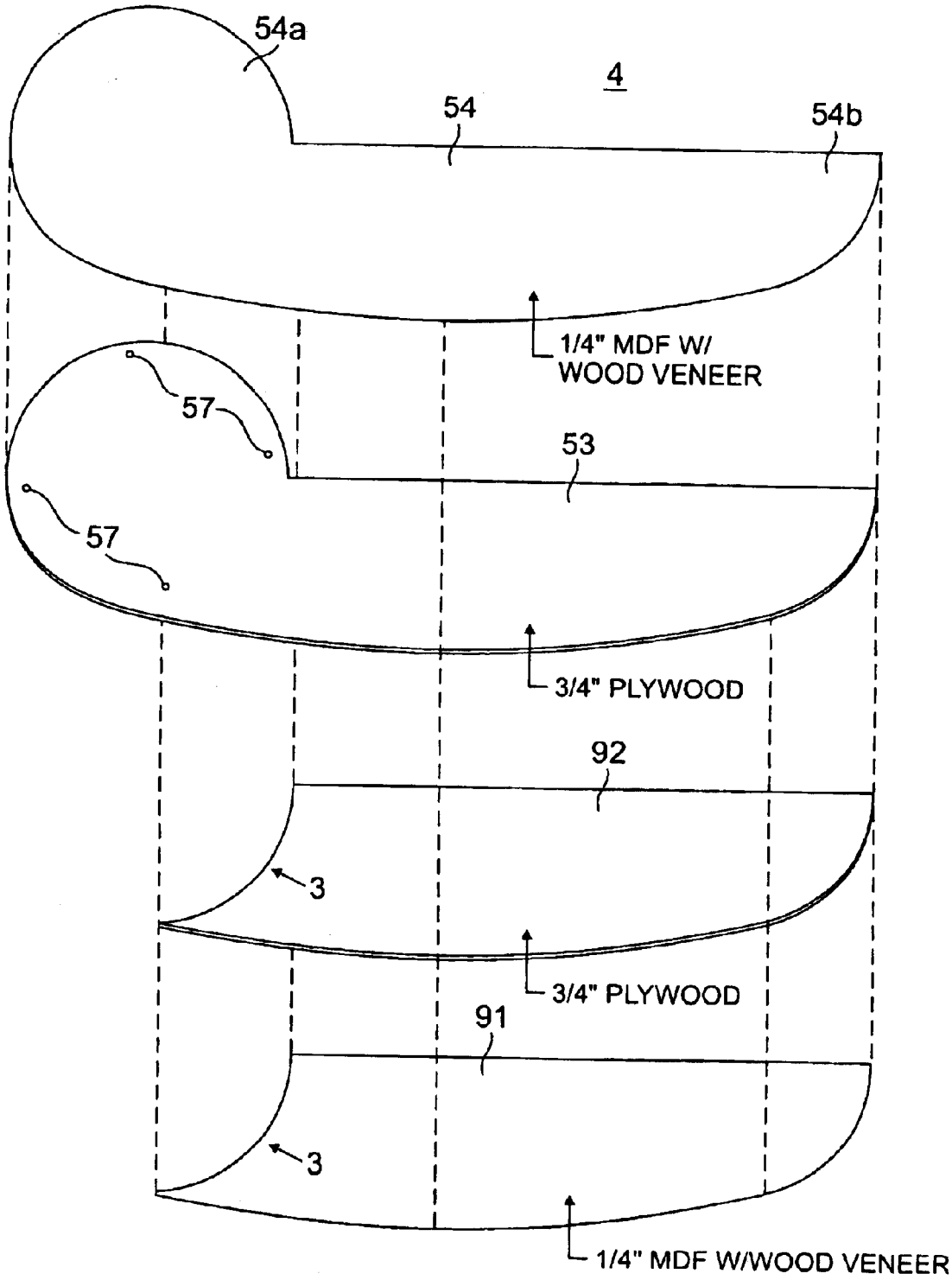
FIG. 9 depicts an exploded view of an exemplary embodiment of a first portion of the top assembly according to another aspect of the present invention.

Turning to FIG. 2, the table 10 is now shown in the open position. The length from the circular section 3 to the openable end 2 is approximately 96 inches. Seam 6 is now opened and circular section 7 is split into two halves. At the point where seam 6 meets circular section at slip joint 3 there is now a depression evident, which is the thickness of the top portion of leaf 4, the structure of which is shown in FIG. 9. Leaf 5 has an inner radial cut along circular section 3 that matches the radius of the circular section 3 so that leaf 5 can move smoothly along the exterior of the circular section 3. Similarly, as can be seen in FIG. 9, leaf 4 has a similarly shaped section so that the bottom half of leaf 4 can move smoothly along the circular section 3.

Figure 3:
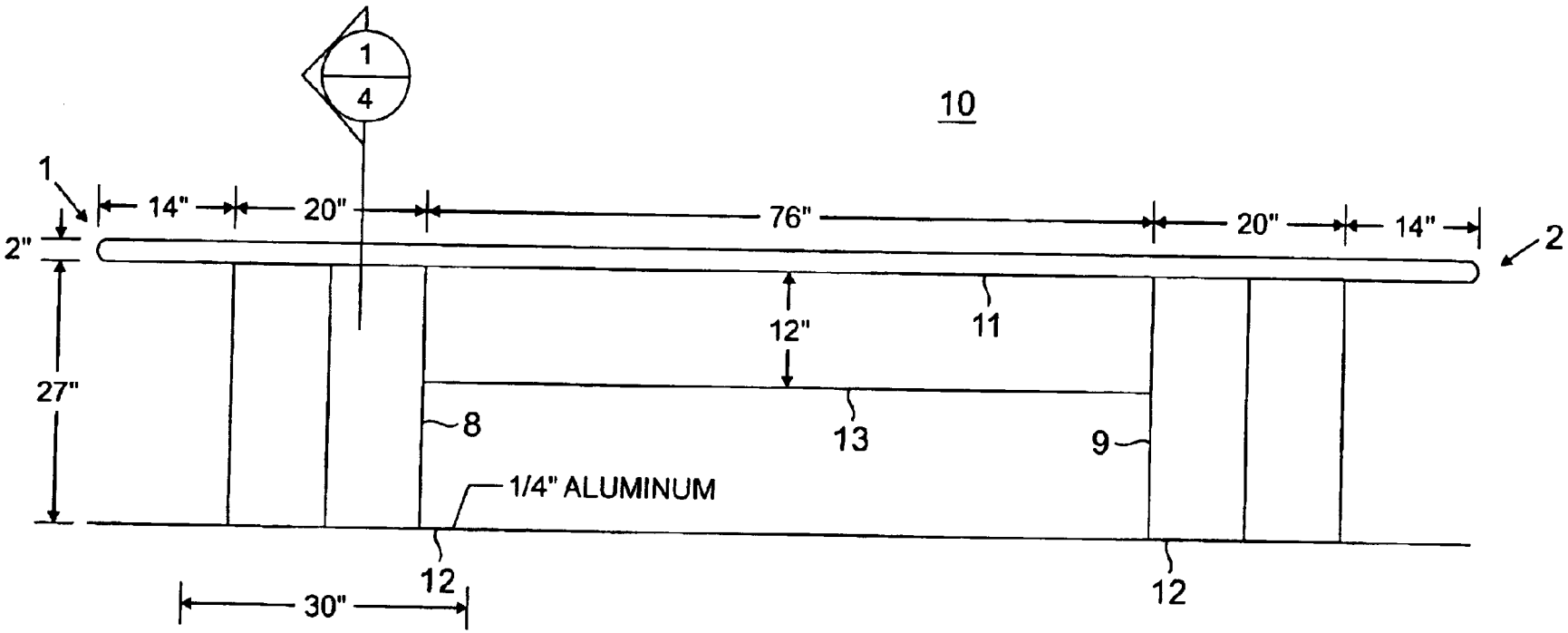
FIG. 3 depicts a side view of the exemplary embodiment of FIG. 1.

FIG. 3 depicts a side view of the exemplary embodiment of FIG. 1. The embodiment has a two-inch thick table surface and is approximately 27 inches above the floor. The table is approximately twelve feet long. Two pedestals or bases 8, 9 support the table surface 11. One pedestal or base 8 disposed at the pivoting end 1 includes a rotatable member (shown in detail in FIGS. 4 and 8) and the other pedestal or base 9 splits in two as the leaves 4, 5 open. This base 9 can include rollers or wheels that enable smooth movement of the leaves. The bases 8, 9 in this embodiment 10 are cylindrical in structure (although other shapes are possible) and have a diameter of approximately 20 inches, have a height of approximately 27 inches and are disposed about 14 inches from the edge of the table 10. A base plate 12 at each end supports the bases 8, 9. A supporting beam or modesty panel 13 mounted between the pedestals or bases 8, 9 may be used to provide additional support. In this embodiment, the beam 13 is disposed about 12 inches below the surface 11.

Figure 4:
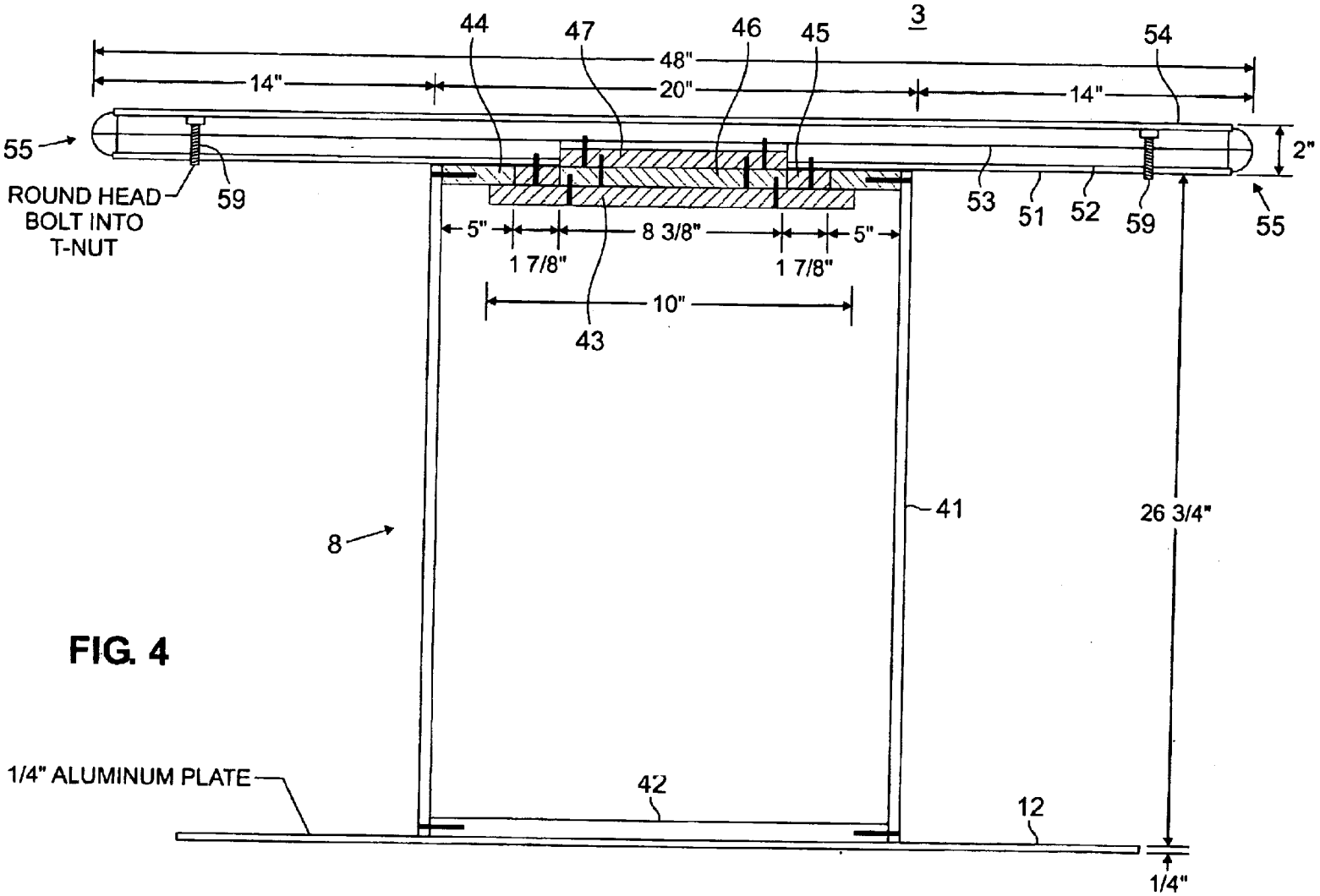
FIG. 4 depicts a sectional view of an exemplary embodiment of the interior of the pivotal end of the conference table of FIG. 1 according to another aspect of the present invention.
Figure 8:
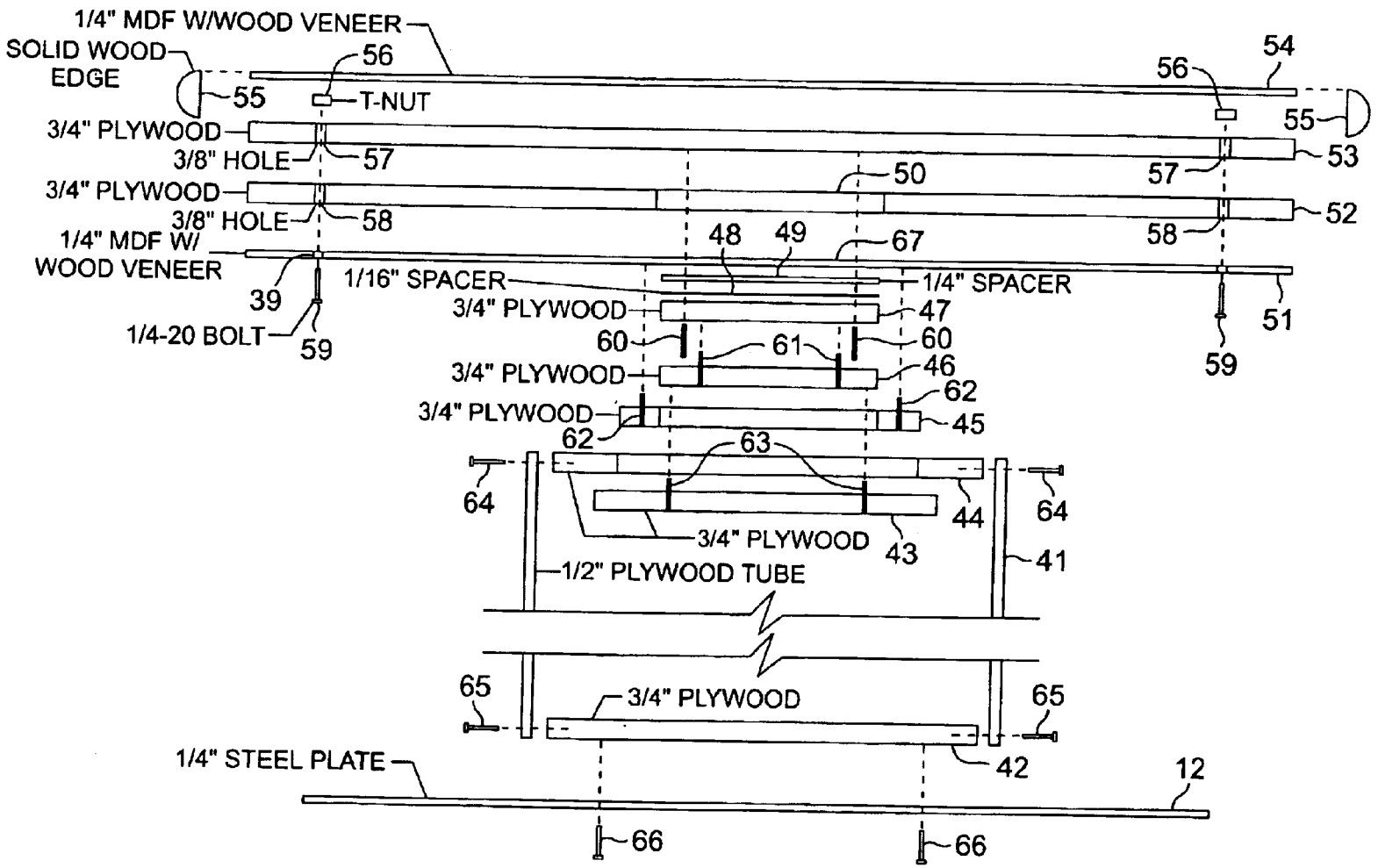
FIG. 8 depicts an exploded sectional view of an exemplary embodiment of the pivot assembly of the conference table of FIG. 1 according to another aspect of the present invention.

FIG. 4 depicts a sectional view of an exemplary embodiment of the interior of the pivoting end 1 of the conference table 10 according to another aspect of the present invention. FIG. 8 shows the same section in an exploded view, and reference will be made alternatively to FIGS. 4 and 8 as the description herein demands. Moving from the floor upward through the interior of the table 10, a 30-inch diameter base plate 12 made of ¼ inch aluminum or steel supports the pedestal 8, which is the pedestal at the pivoting end 1 of the table 10. A 20-inch diameter tube 41 of ½ inch thick plywood forms the sides of the base 8 and a 19-inch diameter ¾ inch thick plywood bottom cap 42 is attached to the cylinder 41 via screws 65 (FIG. 8). The bottom cap 42 is attached to the base plate 12 via screws 66 (FIG. 8). At the top of the cylinder 41, a ring 44 having a radial measurement of three inches and made of ¾ inch thick plywood is mounted via screws 64 (FIG. 8). In this embodiment, ring 44 does not rotate. A second ring 45 of ¾ inch thick plywood (having a radial measurement of 1 ⅞ inches) is disposed inside first ring 44, which second ring 45 is mounted to the bottom portion (¼ inch medium density fiberboard with wood veneer 51 and ¾ inch thick plywood 54) of the circular section 3 via screws 62. Ring 45 rotates inside ring 44 as pieces 51 and 52 rotate relative to pieces 53 (¾ inch thick plywood) and 54 (¼-inch thick medium density fiberboard with wood veneer), respectively. A shaft (comprised of ¾ inch thick plywood circular pieces 43, 46 and 47 and 1/16 inch plywood spacer 48 (FIG. 8), and ¼ inch plywood spacer 49 (FIG. 8)) rotates inside ring 45 during this relative rotation of the circular pieces 51, 52 and 53, 54, respectively. Circular piece 47 has a diameter (15 inches) that is larger than the opening of ring 44 (13 inches), thereby locking the shaft in place. The shaft (43, 46, 47) attaches via screws (see FIG. 8 for details) to the top portion (veneer 54 and plywood 53) of the circular section 3. As the top portion (54, 53) rotates relative to the bottom portion (51, 52), the shaft (43, 46, 47) rotates as well. As shown, circular piece 43 is attached to circular piece 46 via screws 63 (FIG. 8) disposed inside ring 45. In turn, circular piece 46 is attached to circular piece 47 via screws 61 (FIG. 8) that are also disposed inside ring 45. In turn, circular piece 47 is attached to circular surface piece 53 via screws 60 (FIG. 8) that pass through a ¼ inch spacers 48 (FIG. 8) and a 1/16-inch spacer 47 (FIG. 8) and through openings 67 and 50 in circular veneer 51 and circular section 52, respectively. Circular piece 47 is disposed in the openings 67 and 50. Round bolts 59 couple with T-nuts 56 disposed in ⅜-inch holes 57. These round bolts 59 pass through slots 58 in circular surface piece 52 and its associated veneer 51. Band 55 (shown in cross-section detail in FIG. 6) disposed around the table provides ornamental finishing to the table edge.

Figure 5:
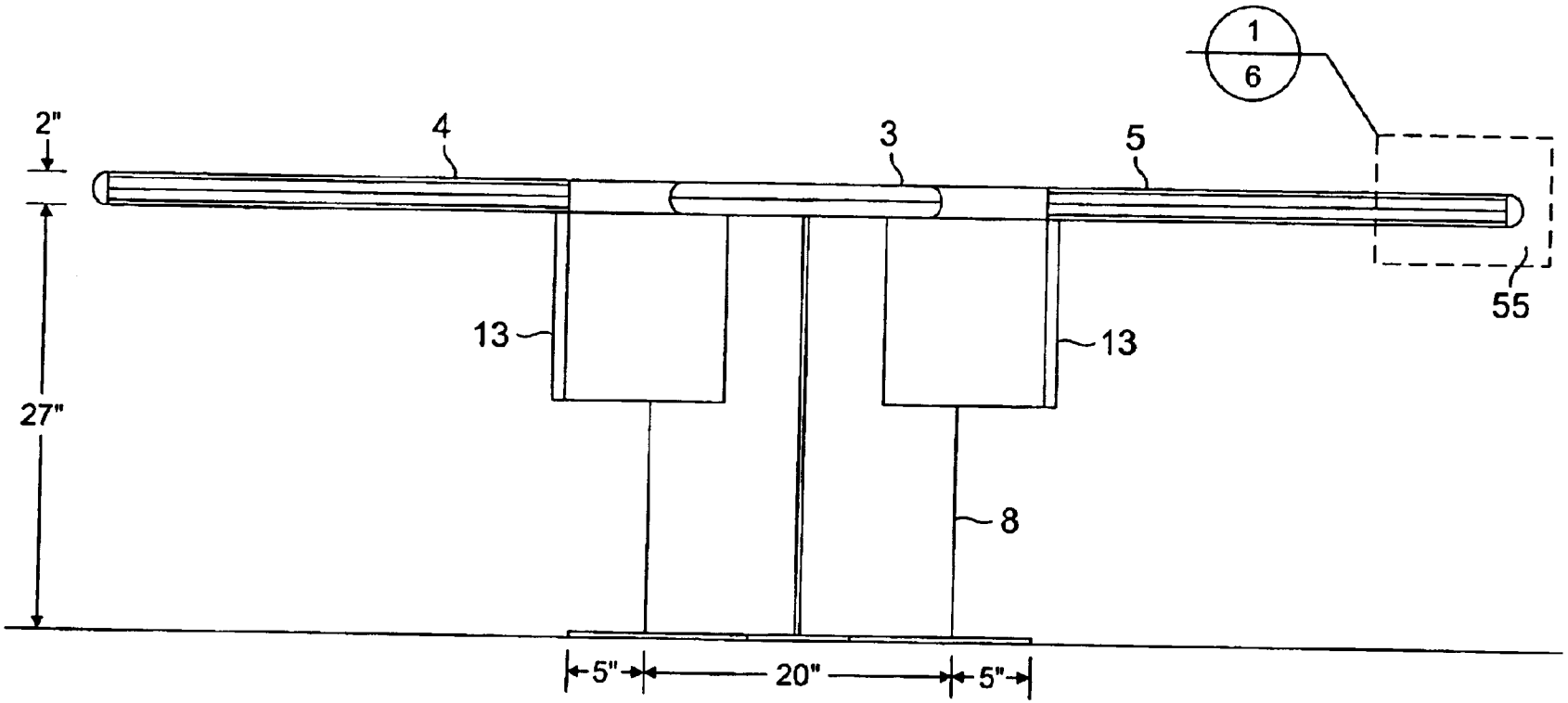
FIG. 5 depicts a cross-sectional view of the conference table of FIG. 1 in an open position according to another aspect of the present invention.

FIG. 5 depicts a cross-sectional view of the conference table of FIG. 1 in an open position according to another aspect of the present invention taken along line 1/5 in FIG. 2. In this view, the modesty panel 13 is shown twice as the slice is performed at an angle.

Figure 6:
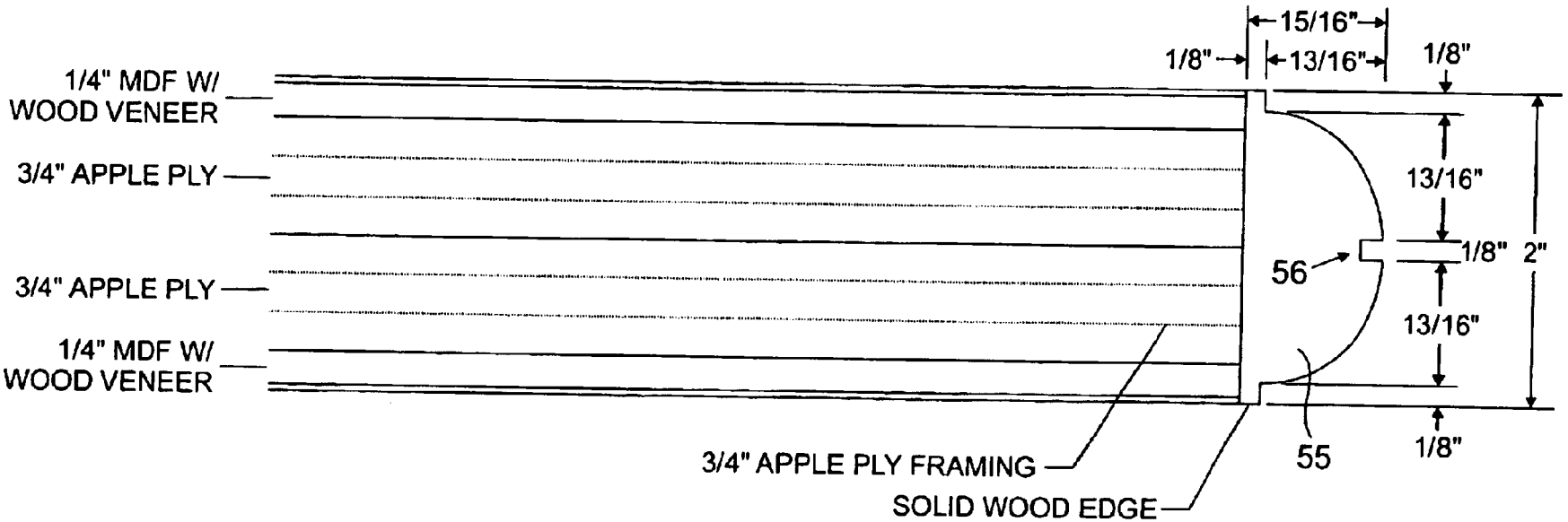
FIG. 6 depicts a detailed view of the table edge of the conference table of FIG. 1 in an open position according to another aspect of the present invention.
Figure 7:
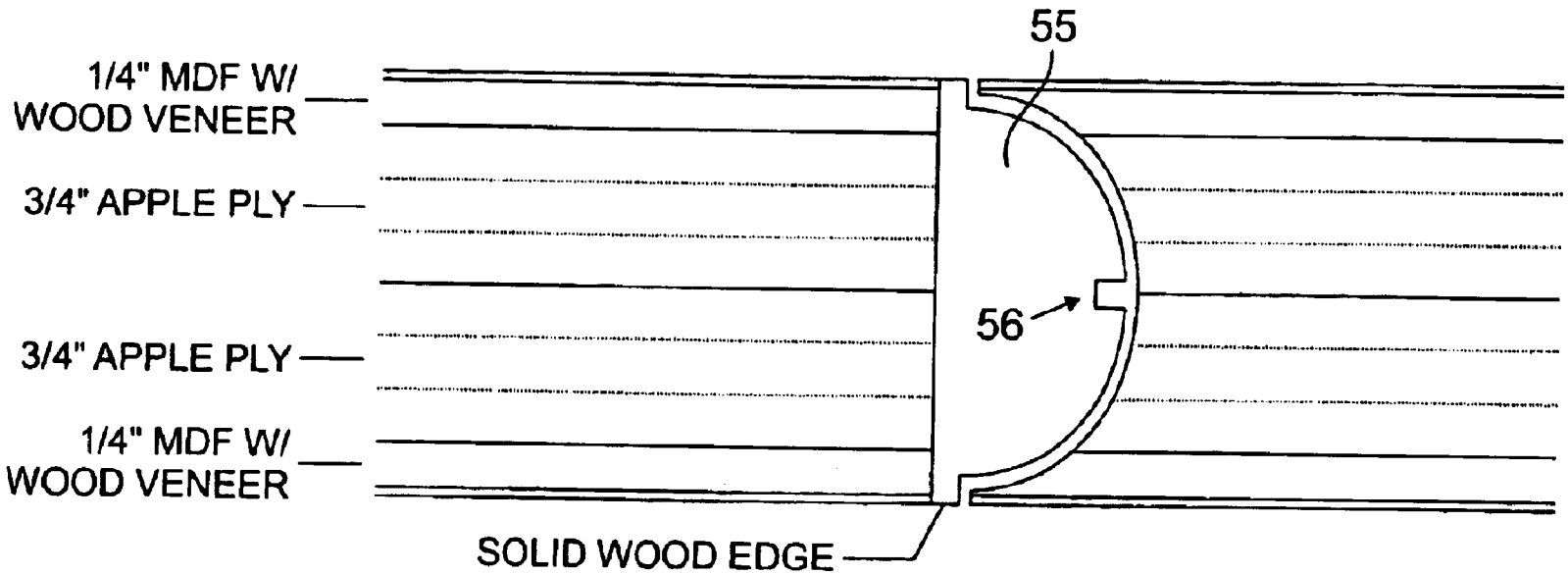
FIG. 7 depicts a detailed view of the table edge of the conference table of FIG. 1 in a closed position according to another aspect of the present invention.

FIG. 6 depicts a detailed view of the table edge of the conference table of FIG. 1 in an open position according to another aspect of the present invention. Table edge 55 is a solid wood band that includes a reveal 56 at the center to provide ornamental finishing. When the circular section 3 meets the leaf section 5, table edge 55 lies at this mating junction. The reveal is ⅛ inch thick. The table edge 55 includes a lip at the top and bottom of about ⅛ inch. The table edge is about 2 inches thick. When the band 55 lies in the outside, the table edge appears as shown in FIG. 7.

FIG. 9 depicts an exploded view of an exemplary embodiment of a first portion of the top assembly according to another aspect of the present invention. The table surface consists of two portions 4, 5. The portion 4 in FIG. 9 has four pieces. A bottom piece 54 made of a medium density fiberboard with wood veneer is approximately ¼ inch thick. The bottom piece 54 has a circular end 54*a* and a blade shaped leaf 54*b*. Mounted on top of the bottom piece 54 is an identically shaped piece of plywood 53 having a thickness of approximately ¾ inch. A blade shaped plywood section 92 is then mounted on the ¾ inch plywood piece 53, which leaves a ¾ inch circular depression at the circular end. Finally, a medium density fiberboard with wood veneer 91 is mounted on the blade shaped plywood 92 for finishing, which leaves a one-inch circular depression at the circular end into which the piece 5 from FIG. 10 fits.

Figure 10:
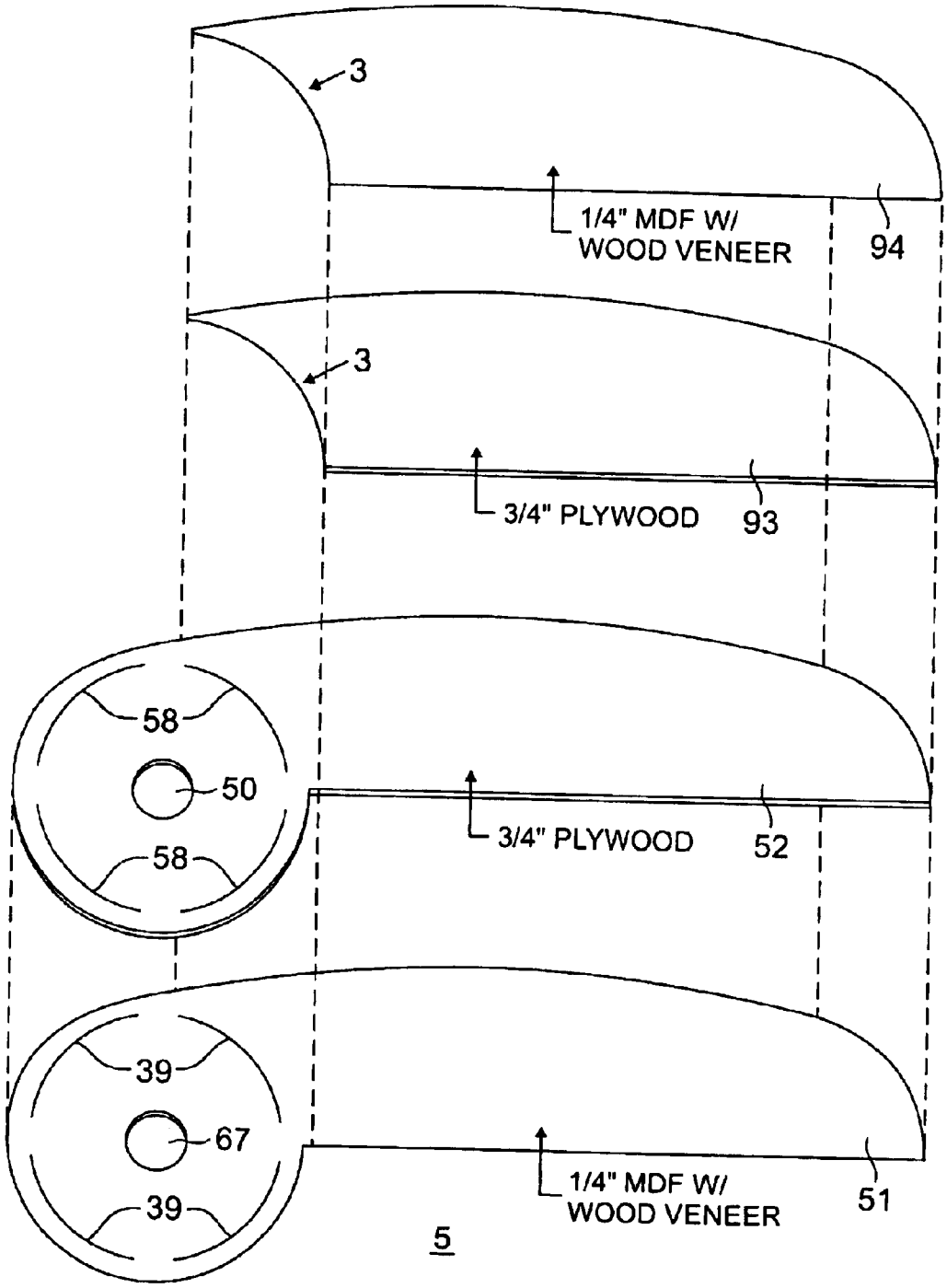
FIG. 10 depicts an exploded view of an exemplary embodiment of a second portion of the top assembly according to another aspect of the present invention.

FIG. 10 depicts an exploded view of an exemplary embodiment of a second portion 5 of the top assembly according to another aspect of the present invention. The above-mentioned one-inch circular depression is then filled with two matching pieces, 51, 52, one of plywood 52 and another of medium density fiberboard with wood veneer 51. Below these two pieces 51, 52 are two blade-shaped pieces, 93, 94, one ¾ inch plywood 93 and one ¼ inch medium density fiberboard with wood veneer 94. The end result is each section of the table has four layers—two of plywood and two of veneer. Veneer piece 51 and plywood piece 52 include a center hole 67, 50, respectively, into which circular piece 47 of the shaft assembly fits (see FIGS. 4 and 8). Veneer price 51 and plywood piece 52 also include slots 39, 58, respectively, into which screws 59 can slide during rotation of the leaves 4, 5. These slots 39, 58 serve as limits for the rotation. The two assemblies 4, 5 in FIGS. 9 and 10, respectively, can then rotate with respect to each other.

Figure 11:
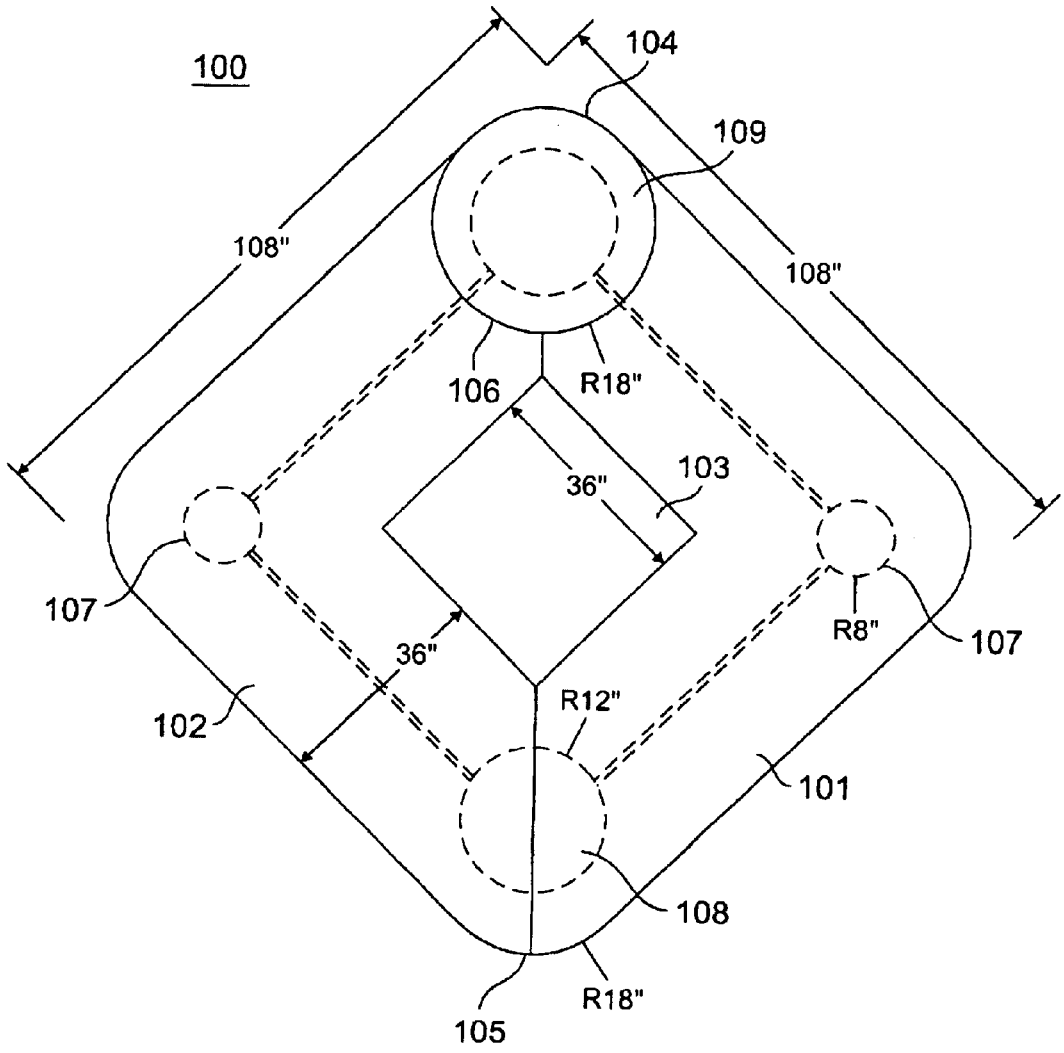
FIG. 11 depicts another exemplary embodiment according to yet another aspect of the present invention.

Turning to FIG. 11, shown therein is another exemplary embodiment 100 according to yet another aspect of the present invention. In this embodiment 100 the table is configured in a substantially rectangular shape. The pivoting end 104 had two arms 101, 102 that open at the opening end 105. Four pedestals or bases 109, 108, 107, 107 provide vertical support. Base 108 splits when the table opens. Base 109 includes the rotary mechanism that enables the arms to rotate from the closed position to the open position (see FIG. 12). As in the prior embodiment, the table includes a slip joint 106 around which the edges of the arms 101, 102 slide as they rotate. This embodiment 100 includes a center console 103 that rolls away when the table is opened.

Figure 12:
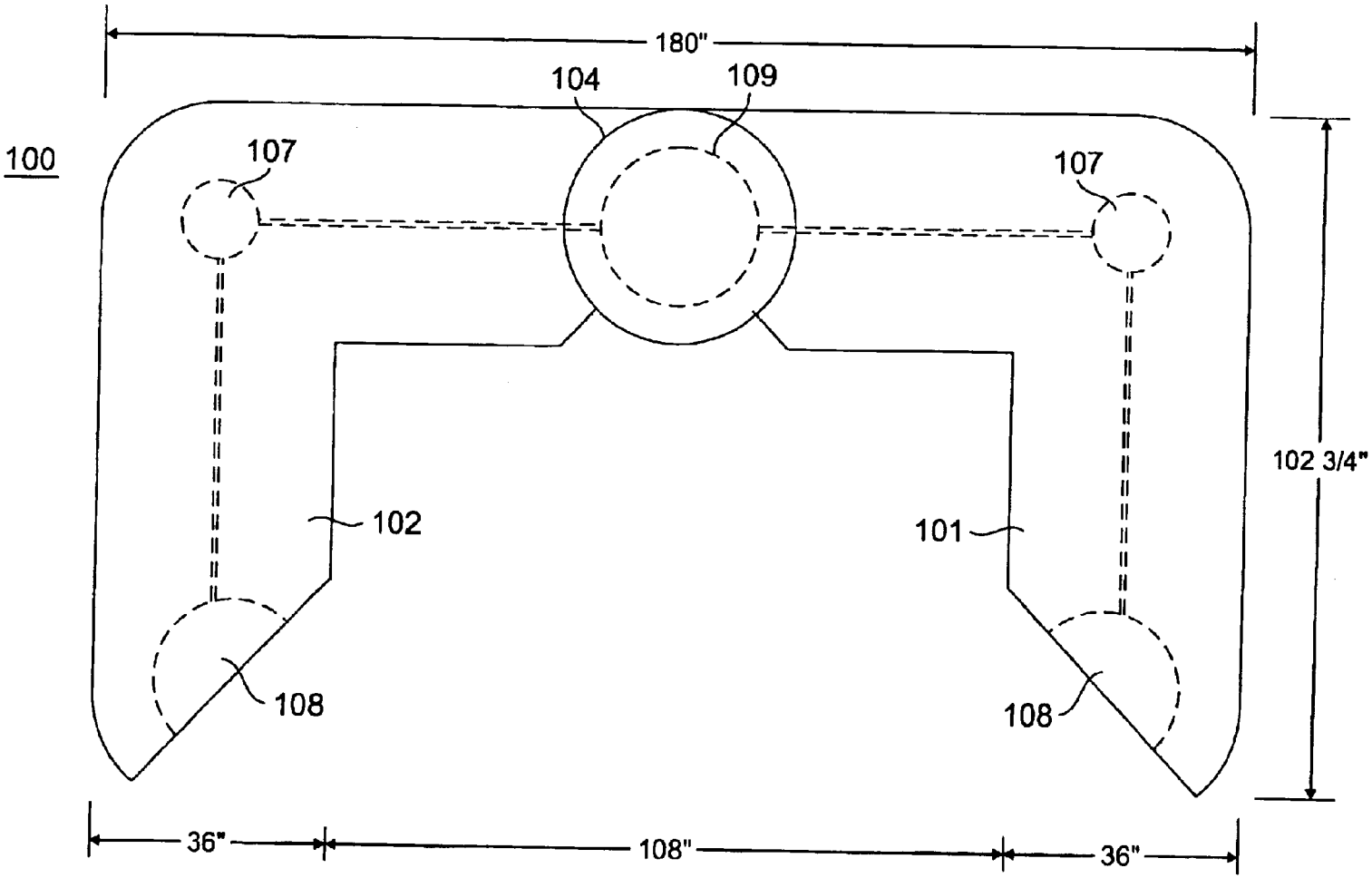
FIG. 12 depicts the exemplary embodiment of FIG. 11 in the open position.

FIG. 12 depicts the exemplary embodiment of FIG. 11 in the open position. In this position, the table serves as an open-ended banquet table or other table.

Figure 13:
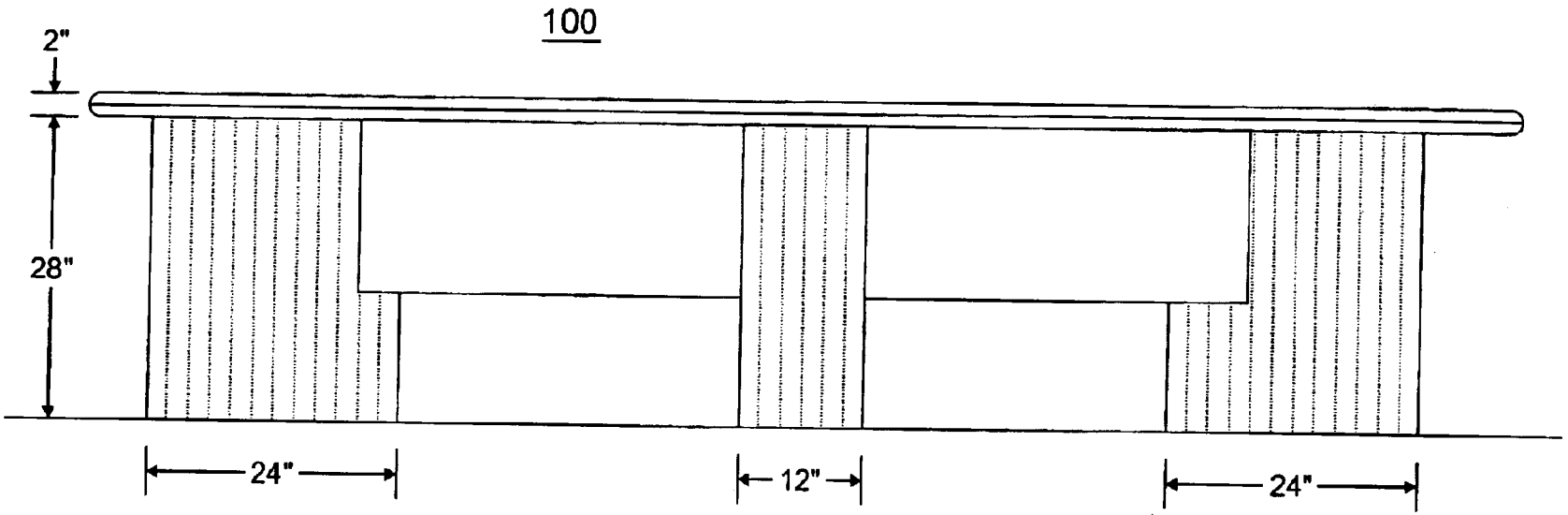
FIG. 13 depicts a cross-sectional view of the exemplary embodiment of FIG. 11.

FIG. 13 depicts a cross-sectional view of the exemplary embodiment of FIG. 11.

Figure 14:
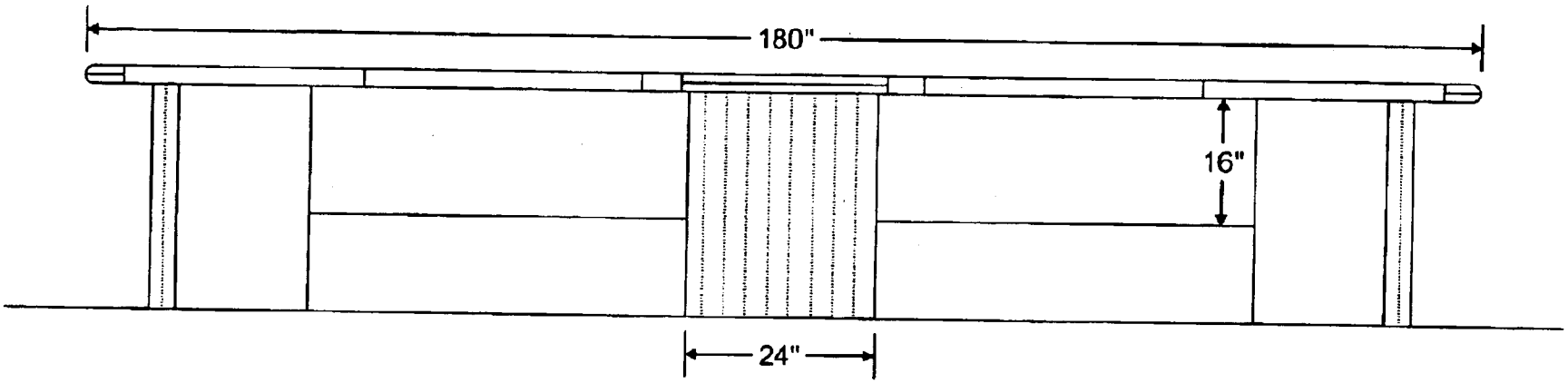
FIG. 14 depicts another cross-sectional view of the embodiment of FIG. 11.

FIG. 14 depicts another cross-sectional view of the embodiment of FIG. 11.

Figure 15:
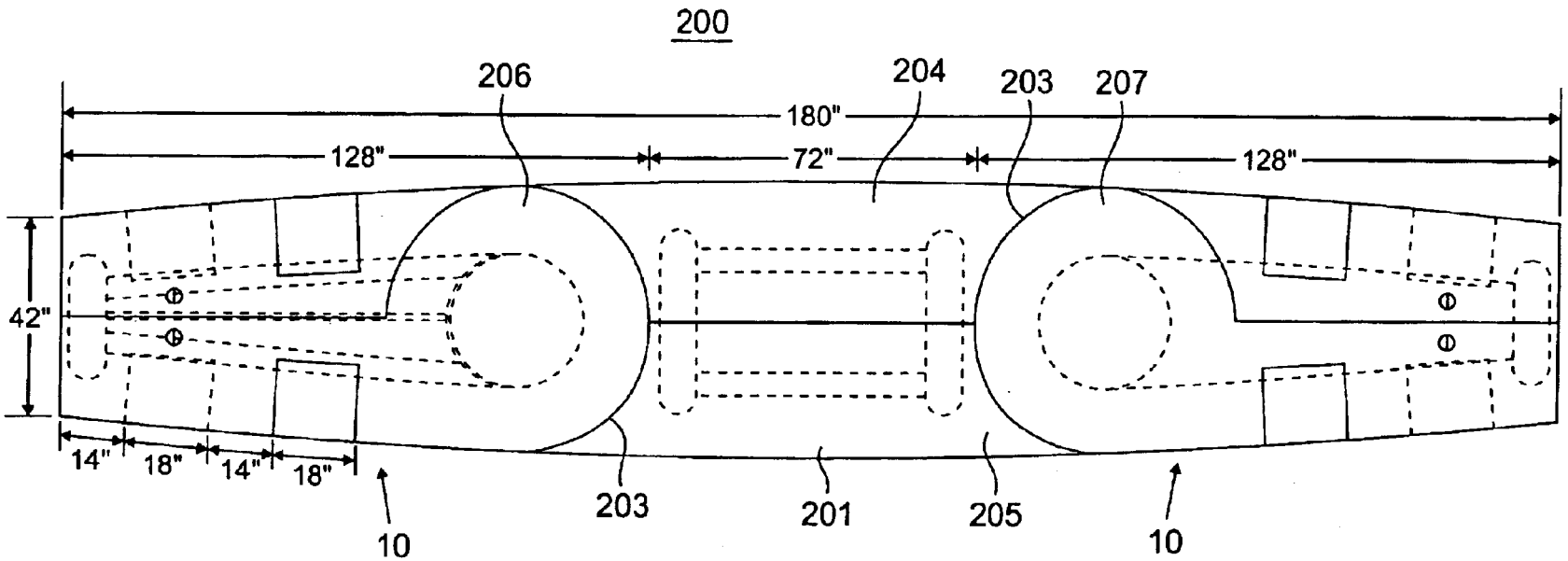
FIG. 15 depicts another exemplary embodiment according to still another aspect of the present invention.

FIG. 15 depicts another exemplary embodiment 200 according to still another aspect of the present invention. This apparatus includes two tables similar to embodiment 10 but joined by a center section 201. This section 201 includes two sections 204, 205 having curved edges that meet at slip joints 203, thereby enabling rotation of the circular sections 206, 207 around their center points. The center sections can be removed, if desired to form two separate tables. Or, the center sections can remain in place during movement of the arms.

Figure 16:
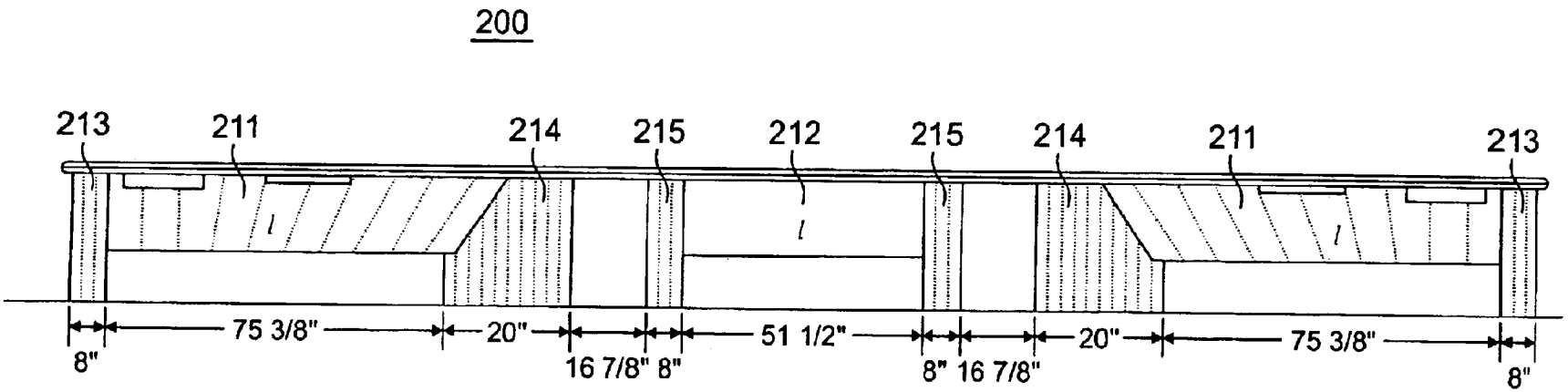
FIG. 16 depicts a cross-sectional view of the exemplary embodiment of FIG. 15.

FIG. 16 depicts a cross-sectional view of the exemplary embodiment of FIG. 15. The table 200 includes three sections. Each section includes a modesty panel 11, 212, 211, respectively. Two center bases 215 support the center section. Two bases 213, 214 support the outer sections. The table is 328 inches long in this embodiment, however, many other lengths are possible.

Although various embodiments are specifically illustrated and described herein, it will be appreciated that modifications and variations of the invention are covered by the above teachings and are within the purview of the appended claims without departing from the spirit and intended scope of the invention. For example, while the above embodiment includes specific dimensions, the invention is not so limited, as tables of varying sizes could be made that incorporate the basic articulation design.

Moreover, there exist other techniques for creating a pivot, any of which techniques could be employed in this invention to enable the articulation motion.

And, the contours and shapes of the various pieces are not necessary to practice the present invention, as many other contours and shapes for tables that would articulate according to the present invention are possible.

Furthermore, a motor could be mounted inside the pedestal and a switch could activate the motor thereby providing an automated articulation. Such automation is made even easier by the use of rolling members or wheels on the bases supporting the articulating leaves.

In addition, the materials used in the description herein are only exemplary.

Many other materials can be employed to create a table that articulates according to the present invention. Various elements of the table could be made of prefabricated parts, rather than wood, such as molded shafts, etc.

Still, additional leaves could be included extending at various angles from the center of the table, such as two leaves at one side and two more at another side opposite from the first side. Another possibility would be to include four leave pairs, each at 90 degrees around a circular center section. This would enable four v-shaped sections to be created.

Finally, these examples should not be interpreted to limit the modifications and variations of the invention covered by the claims but are merely illustrative of possible variations.

What is claimed is:

1. An articulating table comprising:

a circular section including a horizontal pivot and having a top surface; and two or more leaves extending outward from the circular section and couplable to each other by rotation via the horizontal pivot to form a common planar surface with the top surface of the circular section when coupled to each other.

2. The table according to claim 1, wherein the two or more leaves can be moved to different angles relative to each other allowing for changes in configuration and capacity.

3. The table according to claim 1, wherein the horizontal pivot comprises a rule joint including a plurality of pivoting members that are attached with offsets allowing the two or more leaves to be placed in a same plane.

4. The table according to claim 3, wherein the rule joint is divided into two or more pivot parts, each attached to one of the two or more leaves.

5. The table according to claim 4, wherein the two or more pivot parts are circular shaped and have either a protrusion or depression concentric to their centers, which fits into a corresponding part on another of the two or more pivot parts, wherein a resulting male/female arrangement provides a bearing surface and maintains alignment as the two or more leaves pivot.

6. The table according to claim 5, further comprising a plurality of intermediate leaves each having a hole in their pivot member to accommodate the bearing assembly.

7. The table according to claim 6, further comprising a plurality of connectors and overlapping slots in inner layers that hold the joint together and limit articulation.

8. The table according to claim 1, further comprising a split base housing two or more rolling members, each of the two or more rolling members supporting one end of the two or more leaves.

9. The table according to claim 1, further comprising a table edge around an exterior of the table, said table edge being coped into an opposite member at a perimeter of a rotary section, allowing for a smooth and unbroken edge profile as the table articulates.

10. An apparatus comprising a horizontal pivot including a plurality of pivot elements stacked vertically on top of each other, a top one of said plurality of pivot elements having a top surface, said plurality of pivot elements being rotatable about the horizontal pivot relative to each other, each of said pivot elements having a substantially circular shape at a first end and a protruding section at a second end, said protruding sections each having a top surface being in a same horizontal plane as all other top surfaces of all other protruding sections, wherein when the plurality of pivot elements are rotated about the horizontal pivot into a first position two or more of said protruding leaves meet to form a common planar surface with the top surface of the top one of the plurality of pivot elements and when rotated about the horizontal pivot into a second position each of said protruding leaves separate to form a plurality of separate horizontal surfaces in a common plane.

11. An apparatus comprising a horizontal pivot including a plurality of pivot elements stacked vertically on top of each other, said plurality of pivot elements being rotatable about the horizontal pivot relative to each other, each of said pivot elements having a substantially circular shape at a first end and a protruding section at a second end, said protruding sections each being in a same horizontal plane as all other protruding sections, wherein when the plurality of pivot elements are rotated about the horizontal pivot into a first position two or more of said protruding leaves meet to form one or more combined horizontal surfaces and when rotated about the horizontal pivot into a second position each of said protruding leaves separating to form a plurality of separate horizontal surfaces; and a motor mounted in the horizontal pivot and automatically rotating the plurality of pivot elements with respect to each other from the first position to the second position.

12. The apparatus according to claim 10, wherein the plurality of pivot elements comprises two pivot elements.

13. The apparatus according to claim 10, wherein the plurality of pivot elements comprises four pivot elements.

14. The apparatus according to claim 10, further comprising a base in which the horizontal pivot is disposed supporting the stack of pivot elements and a base for each of the protruding sections supporting the protruding sections, wherein in the first position the bases of the protruding sections meet to form a common base and in the second position the bases of the protruding sections split to form a base for its associated protruding section.

15. An apparatus for creating a plurality of work surfaces comprising:

a plurality of surface elements, each of said plurality of surface elements having two parts, a first part having a first shape and being stackable vertically with all other first parts of the plurality of surface elements all of which are aligned on a common center, a second part having a second shape and being alignable horizontally with all other second parts to form a common planar surface with all other second parts and a top of the stack of first parts; and a shaft attached to at least one of the plurality of surface elements enabling rotation of the plurality of surface elements with respect to each other around the common center so that in a first position around the common center the plurality of surface elements align to form the common planar surface and in one or more others positions around the common center the plurality of surface elements separate to form two or more separate horizontal surfaces in a common plane.

16. The apparatus according to claim 15, further comprising a common base housing the shaft and supporting the stack of first parts of the plurality of surface elements.

17. The apparatus according to claim 16, further comprising a split base supporting the plurality of second parts of the plurality of surface elements when in the first position and splitting to support each of the plurality of second parts of the plurality of surface elements when in the one or more other positions.

18. An apparatus for creating a plurality of work surfaces comprising:

a plurality of surface elements, each of said plurality of surface elements having two parts, a first part having a first shape and being stackable vertically with all other first parts of the plurality of surface elements all of which are aligned on a common center, a second part having a second shape and being alignable horizontally with all other second parts to form a common horizontal surface with all other second parts and a top of the stack of first parts; and a shaft attached to at least one of the plurality of surface elements enabling rotation of the plurality of surface elements with respect to each other around the common center so that in a first position around the common center the plurality of surface elements align to for the common horizontal surface and in one or more others positions around the common center the plurality of surface elements separate to form two or more separate horizontal surfaces; and a motor mounted in the common base and coupled to the shaft and automatically rotating the plurality of surface elements with respect to each other from the first position to the one or more other positions.

19. The apparatus according to claim 15, wherein the plurality of surface elements comprises two surface elements.

20. The apparatus according to claim 15, wherein the plurality of surface elements comprises four or more surface elements.

* * * * *

UNITED STATES PATENT AND TRADEMARK OFFICE

CERTIFICATE OF CORRECTION

PATENT NO. : 6,715,428 B2
DATED : April 6, 2004
INVENTOR(S) : Daniel Curtis Wilcox It is certified that error appears in the above-identified patent and that said Letters Patent is hereby corrected as shown below:

Column 1,
Line 18, before "reconvenes" change "the" to -- then --.

Column 4,
Line 32, after "screws 62" insert -- (FIG. 8) --.
Line 52, change "spacers 48" to -- spacer 49 --.
Lines 52-53, change "spacer 47" to -- spacer 48 --.

Column 5,
Line 38, change "Veneer price 51" to -- Veneer piece 51 --.
Line 47, change "had two arms" to -- has two arms --.

Column 6,
Line 9, change "11" to -- 211 --.

Column 7,
Lines 52 and 54, after "position", insert -- , --.
Line 55, change "separating" to -- separate --.

Column 8,
Line 11, after "elements", insert --, --.
Line 22, change "others" to -- other --.
Line 50, change "for" to -- form --.

Signed and Sealed this

Twenty-seventh Day of July, 2004

JON W. DUDAS
*Acting Director of the United States Patent and Trademark Office*